United States Patent [19]

Mumford

[11] Patent Number: 4,697,716

[45] Date of Patent: Oct. 6, 1987

[54] CLOSURES WITH CAST SEALING GASKET

[75] Inventor: George V. Mumford, Ventura, Calif.

[73] Assignee: Owens-Illinois, Inc., Toledo, Ohio

[21] Appl. No.: 395,394

[22] Filed: Jul. 6, 1982

[51] Int. Cl.[4] ..... B65D 53/02

[52] U.S. Cl. ..... 215/352; 215/341

[58] Field of Search ..... 215/341, 343, 350, 352, 215/353

[56] References Cited

U.S. PATENT DOCUMENTS

| | | | |
|---|---|---|---|
| 802,381 | 10/1905 | Fenn | 215/352 |
| 1,327,963 | 1/1920 | Ramsey | 215/352 |
| 1,725,101 | 8/1929 | Podel | 215/352 |
| 2,172,825 | 9/1939 | White | 215/353 |
| 2,312,513 | 3/1943 | Wilson | 215/350 |
| 2,562,548 | 7/1951 | Hanson | 215/352 |
| 4,076,156 | 2/1978 | Mumford | 215/350 |
| 4,331,249 | 5/1982 | Banich, Sr. | 215/343 |
| 4,346,812 | 8/1982 | Banich, Sr. | 215/352 |
| 4,381,840 | 5/1983 | Ostrowsky | 215/350 |

*Primary Examiner*—Stephen Marcus
*Assistant Examiner*—David T. Fidei
*Attorney, Agent, or Firm*—Howard G. Bruss

[57] ABSTRACT

A closure for a container comprising a body of synthetic plastic material including a top wall and a peripheral skirt, removably engaging a container. An annular channel is provided on the inner surface of the top wall at the area of juncture of the top wall and the skirt. The channel comprises integral side wall portions and at least one of said side walls comprises spaced generally vertically extending ribs. A sealing gasket is cast in situ in the channel and interlocks with the spaced ribs.

7 Claims, 19 Drawing Figures

CLOSURES WITH CAST SEALING GASKET

This relates to plastic closures and particularly plastic closures for attachment to containers which are subjected to high temperature heat processing.

BACKGROUND AND SUMMARY OF THE INVENTION

In the packaging of various goods, it is common to subject the goods sealed in the container to high temperature for various purposes. Where the container comprises a body such as glass and a cap made of plastic, it has long been known that in order to provide a durable seal, a soft elastomeric sealant should be cast in situ in the cap. One of the problems with respect to such a sealant arrangement is that the sealing material such as plastisol does not readily adhere to the plastic and therefore can slip and not stay in place.

It has heretofore been proposed, for example, in U.S. Pat. Nos. 3,603,472 and 4,244,481, that a channel be provided in the cap with annular undercut portions to retain the sealing ring which is cast in situ against axial movement, that is, from falling out of its position. However, there is still a tendency for the ring to slip or rotate.

Accordingly, among the objects of the present invention are to provide a plastic closure having a sealing ring which is cast in situ and is prevented from rotating as well as moving axially with respect to the closure.

In accordance with the invention, the closure for a container comprises a body of synthetic plastic material including a top wall and a peripheral skirt having means thereon for engaging a container. An annular channel is provided on the inner surface of the top wall at the area of juncture of the top wall and the skirt. The channel comprises integral side wall portions. At least one of said side walls comprising spaced generally vertically extending ribs and a sealing gasket is cast in situ in the channel so that the gasket interlocks with the spaced ribs.

DESCRIPTION

Figure 1:
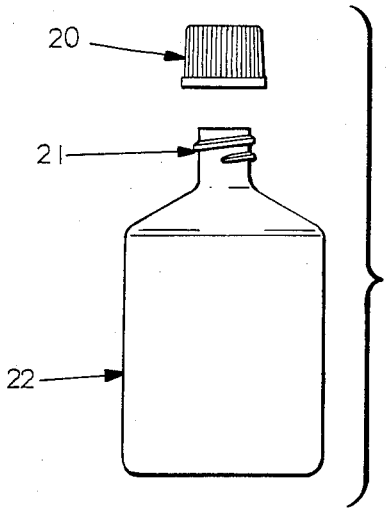
FIG. 1 is an exploded view of a container and closure embodying the invention.

Referring to FIG. 1, the plastic closure 20 embodying the invention is adapted to be applied to interengaging means such as threads 21 on the open end of a container 22.

Figure 2:
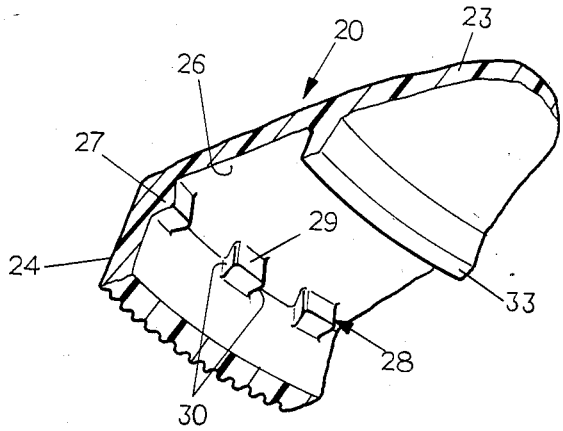
FIG. 2 is a fragmentary perspective view of the closure on an enlarged scale.
Figure 3:
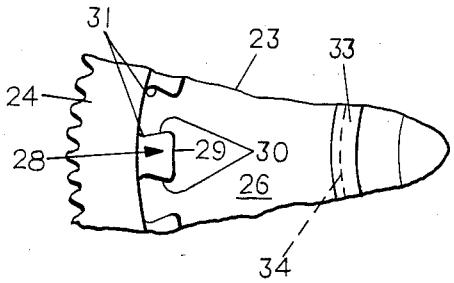
FIG. 3 is a fragmentary plan view of the closure.
Figure 4:
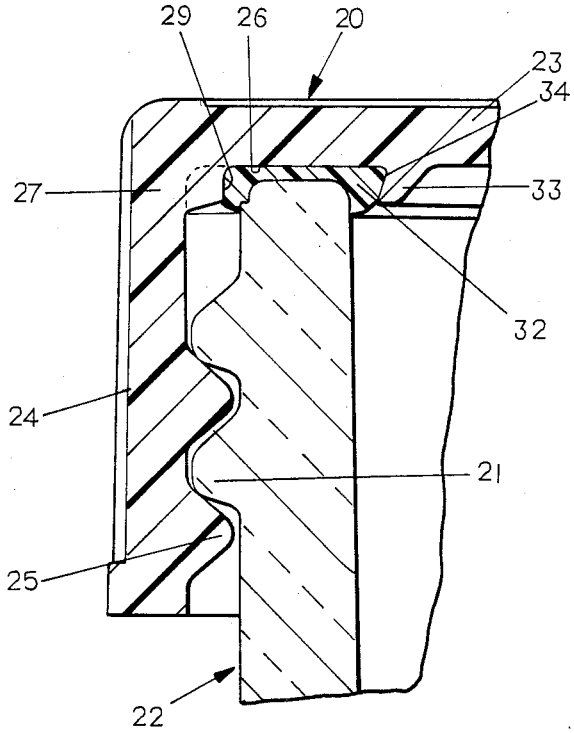
FIG. 4 is a fragmentary sectional view of the closure.

Referring to FIGS. 2–4, the plastic closure 20 embodying the invention is made of a hard, temperature resistant plastic such as polypropylene and comprises a top wall 23, a peripheral skirt 24 having internal threads 25 adapted to engage the threads 21 on the neck of the container 22.

In accordance with the invention, an integral channel 26 is formed in the underside of the top wall 23 of the closure at the area of juncture with the peripheral skirt.

The outer wall 27 of the channel 26 is formed by a plurality of vertically extending ribs 28 defining valleys. Ribs 28 are in the general form of a dovetail including a vertical end wall 29 and side walls 30 that extend vertically and taper toward one another to define re-entrant portions 31. The sealant such as plastisol is cast in situ so that it fills the channel 26 and the spaces between the ribs including re-entrant portions 31 thereby forming a gasket 32 which is locked against movement rotationally and axially. The inner wall 33 of the channel 26 includes a surface 34 that extends downwardly and radially outwardly from the top wall 23 defining an annular re-entrant portion into which the sealant flows so that the gasket is prevented from moving axially of the closure.

Figure 5:
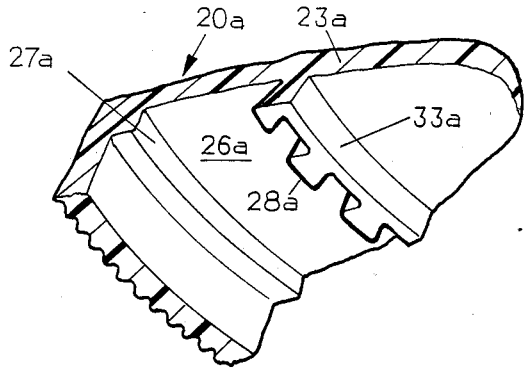
FIG. 5 is a fragmentary perspective view on an enlarged scale of a modified form of closure.
Figure 6:
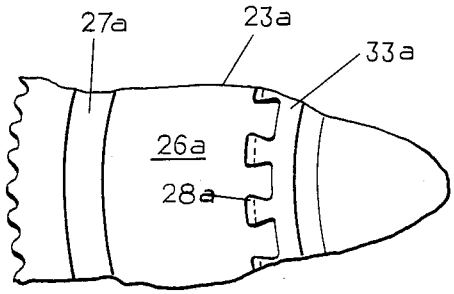
FIG. 6 is a fragmentary bottom plan view of the modified form of closure shown in FIG. 5.
Figure 7:
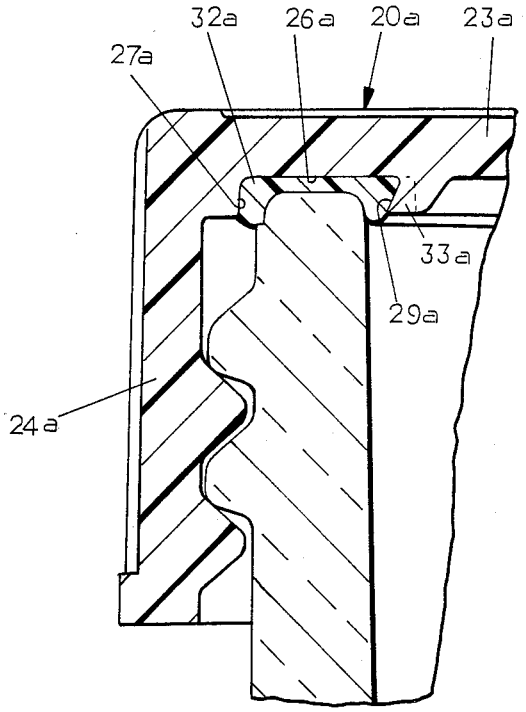
FIG. 7 is a fragmentary elevational view of the container and closure shown in FIGS. 5 and 6.

In the form of closure shown in FIGS. 5–7, the closure **20*a* has a channel 26*a* formed in the undersurface of the top wall 23*a* that has an annular vertical outer wall 27*a* and an inner wall that has a plurality of circumferentially spaced ribs 28*a* on inner wall 33*a* that have a cross section substantially the same as defined with respect to the ribs 28 except that the ends 29*a* taper downwardly and radially outwardly from the top wall to define re-entrant portions on the ends of ribs 28*a*. When the sealant is cast in situ, the gasket formed engages the re-entrant portions between the ribs 28*a* to prevent rotational movement of the gasket 32*a* and the inclined ends 29*a*** prevent axial movement of the gasket.

Figure 8:
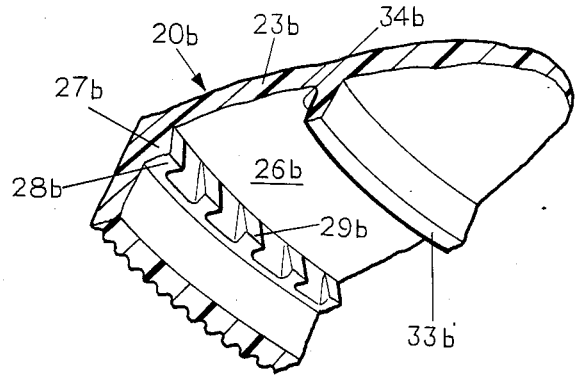
FIG. 8 is a fragmentary perspective view of a portion of a further modified form of closure.
Figure 9:
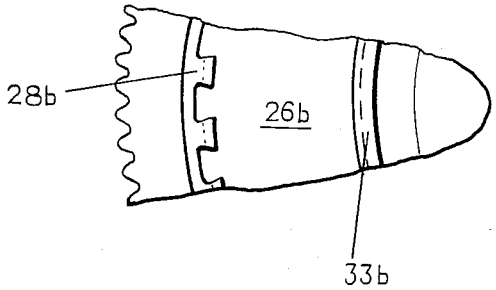
FIG. 9 is a fragmentary bottom plan view of the closure shown in FIG. 8.
Figure 10:
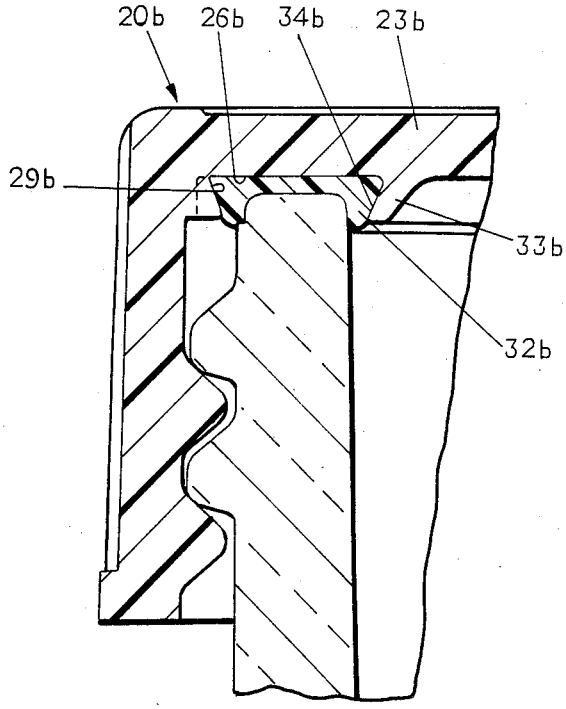
FIG. 10 is a fragmentary elevational view of the container and closure shown in FIGS. 8 and 9.

In the form of the closure shown in FIGS. 8–10, the closure **20*b* has ribs 28*b* on the outer wall 27*b* of the channel 26*b* which have a configuration in horizontal cross section like the ribs shown in FIGS. 2–4, except that the ribs 28*b* have end surfaces 29*b* that taper downwardly and radially inwardly from the top wall 23*b* so that the ribs 28*b* tend to lock the gasket 32*b* against rotational and axial movement. As in the previous form described in FIGS. 2–4, the inner wall 33*b* includes an inclined surface 34*b*** that tapers downwardly and outwardly to lock the inner edge of the gasket against axial movement.

Figure 11:
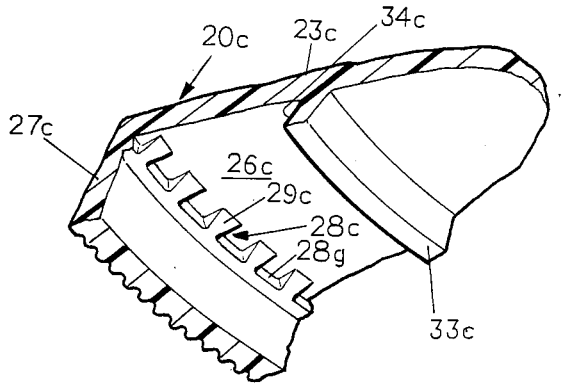
FIG. 11 is a fragmentary perspective view on an enlarged scale of another form of closure.
Figure 12:
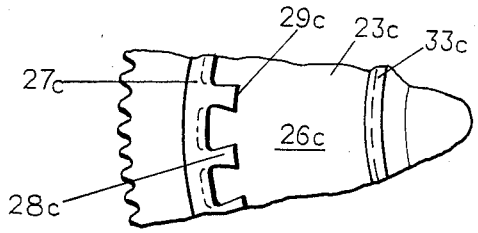
FIG. 12 is a fragmentary bottom plan view of a closure shown in FIG. 11.
Figure 13:
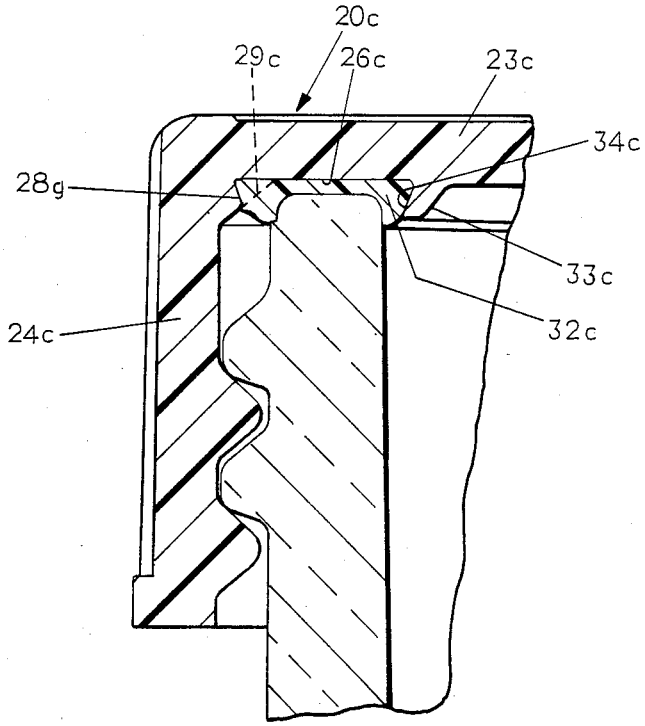
FIG. 13 is a fragmentary sectional elevational view of the container and closure shown in FIGS. 11 and 12.

In the form shown in FIGS. 11–13, the closure 20*c* has a plurality of ribs 28*c* formed in the outer wall 27*c* of the channel 26*c* except that the outer surface 29*c* of each rib tapers downwardly and radially outwardly from the top wall 23*c*. However, the base 28*g* of the spaces between ribs 28*c* is inclined downwardly and radially inwardly to lock the outer edge of the gasket 32*c* against axial movement. As in the form of the invention shown in FIGS. 2–4 and 8–10, the inner wall 33*c* that has a surface 34*c* extending downwardly and radially outwardly to lock the gasket 32*c* against axial movement.

Figure 14:
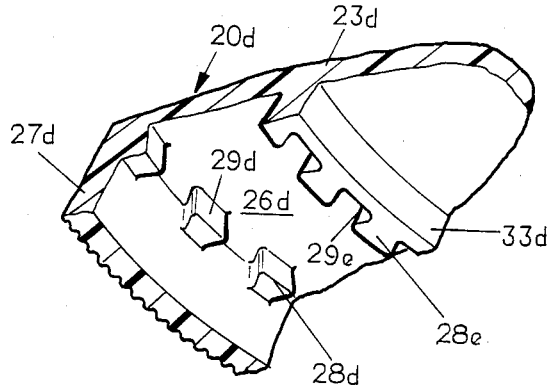
FIG. 14 is a fragmentary perspective view of another form of closure.
Figure 15:
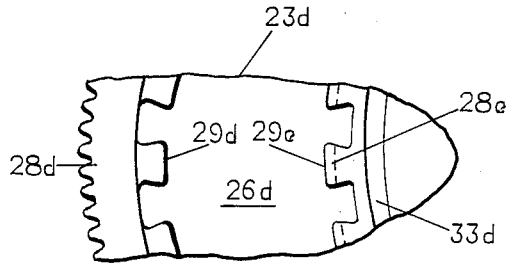
FIG. 15 is a fragmentary bottom plan view of the closure shown in FIG. 14.
Figure 16:
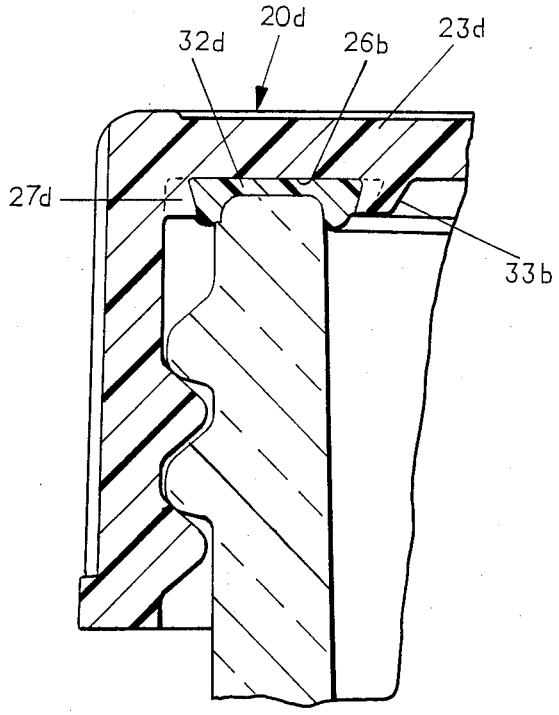
FIG. 16 is a fragmentary sectional elevational view of a container and closure shown in FIGS. 14 and 15.

Referring to the closure shown in FIGS. 14–16, the closure 20*d* has ribs 28*d*, 28*e* on both the outer wall 27*d* and the inner wall 33*d* of the channel 26*d*. Each of the ribs has the cross sectional configuration as shown and described in connection with FIGS. 2–4. In addition, the outer ends 29*d*, 29*e* of the ribs 28*d*, 28*e*, respectively, taper downwardly toward one another to form annular re-entrant portions for holding the gasket 32*d* against axial movement at both its outer and inner peripheries.

Figure 17:
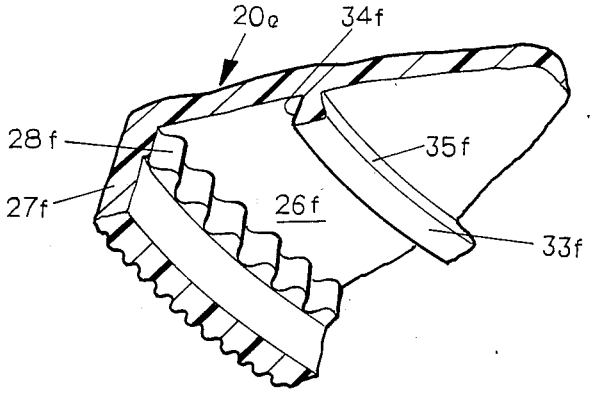
FIG. 17 is a fragmentary perspective view on an enlarged scale of a further form of closure.
Figure 18:
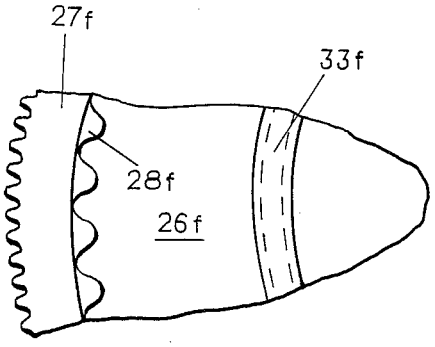
FIG. 18 is a fragmentary bottom plan view of the closure shown in FIG. 17.
Figure 19:
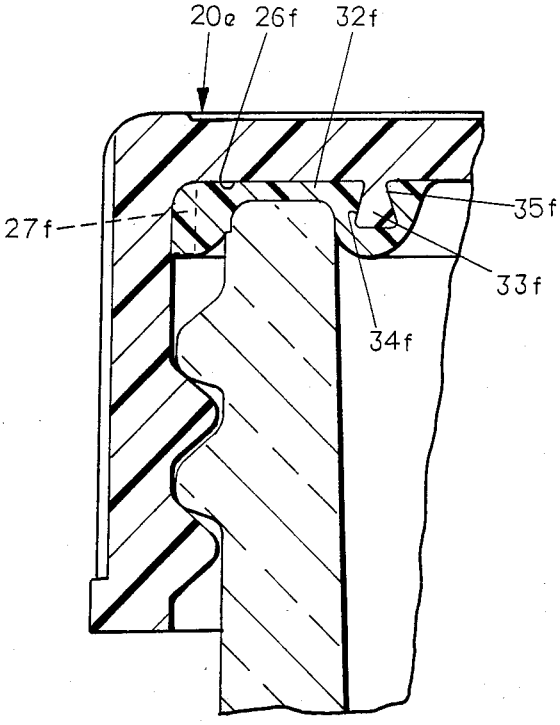
FIG. 19 is a fragmentary sectional elevational view of a container and closure shown in FIGS. 17 and 18.

In the modified form of closure shown in FIGS. 17–19, the closure 20*e* is formed with a plurality of vertically extending ribs 28*f* along the inner wall 27*f* of the channel 26*f*. The ribs are generally V or U shaped with the apices and valleys gradually blending with one another without re-entrant portions. Thus, these ribs function to prevent rotational movement only of the gasket 32*f*. The inner wall 33*f* of the channel 26*f* is formed with an outer surface 34*f* and an inner surface 35*f* which taper downwardly and outwardly diverging from one another to form annular reentrant grooves. The sealant is cast about the entire rib or wall 33*f* so that the re-entrant portions defined by the surfaces 34*f*, 33*f* tend to prevent axial movement of the resultant gasket 32*f*.

I claim:

1. A closure for a container comprising a body of synthetic plastic material including a top wall and a peripheral skirt, said skirt having means thereon for engaging a container, a channel on the inner surface of the top wall at the area of juncture of the top wall and the skirt, said channel comprising an integral bottom wall and radially spaced integral side walls, at least one of said side walls comprising circumferentially spaced generally vertically extending integral ribs, each said rib extending radially from said one wall and having an end surface and side surfaces, said side surfaces of each said rib extending from said side wall toward said end surface, said side surfaces tapering toward one another from the end surface to the side wall to define a re-entrant portion between each side surface and the side wall into which the gasket material extends, and a sealing gasket of gasket material cast in situ in said channel, said gasket interlocking with the spaced ribs.

2. The closure set forth in claim 1 wherein said ribs are on the radially outermost side wall of said channel.

3. The closure set forth in claim 2 wherein the other said side wall of said channel tapers axially and radially outwardly from said top wall of the closure.

4. The closure set forth in claim 1 wherein said ribs are on the radially innermost side wall of said channel.

5. The closure set forth in claim 4 wherein the end surface of each said rib tapers axially and radially outwardly from said top wall.

6. The closure set forth in claim 1 wherein the other said side wall of said channel has a plurality of circumferentially spaced ribs, each said rib extending radially from said other side wall and having an end surface and side surfaces, said side surfaces of each said rib extending from said other side wall toward said end surface, said side surfaces tapering toward one another from the end surface to the other side wall to define a re-entrant portion between each side surface and the other side wall into which the gasket material extends.

7. The closure set forth in claim 6 wherein the end surface of each said rib in the one said side wall tapers axially and radially inwardly from said top wall and the end surface of each said rib on said other side wall tapers axially and radially outwardly from said top wall.

* * * * *